US005781609A

United States Patent [19]

Gerling

[11] Patent Number: 5,781,609

[45] Date of Patent: Jul. 14, 1998

[54] DRIVE DEVICE FOR A ROTARY ANODE OF AN X-RAY TUBE

[75] Inventor: Dieter Gerling, Aachen, Germany

[73] Assignee: U.S. Philips Corporation, New York, N.Y.

[21] Appl. No.: 759,659

[22] Filed: Dec. 6, 1996

[30] Foreign Application Priority Data

Dec. 23, 1995 [DE] Germany ..... 195 48 693.5
May 30, 1996 [DE] Germany ..... 196 21 707.5

[51] Int. Cl.[6] ..... H01J 35/10

[52] U.S. Cl. ..... 378/131; 378/125

[58] Field of Search ..... 378/131, 125

[56] References Cited

FOREIGN PATENT DOCUMENTS 9415240 3 11/1994 Germany .

*Primary Examiner*—Craig E. Church
*Attorney, Agent, or Firm*—Edward Blocker

[57] ABSTRACT

The invention relates to a drive device for a rotary anode of an X-ray tube having a drive motor with a stator (10) and a rotor (15; 21) which drives the rotary anode, the stator (10) and the rotor (15; 21) being separated by a gap and the stator (10) having slots (11) whose circumferential length (17) has been dimensioned for driving a bipolar X-ray tube. In order to enable a more universal use of such a drive device the stator (10), which has been dimensioned for driving the bipolar X-ray tube, is also used for driving a unipolar X-ray tube, the diameter of the rotor (21) and thus the gap (22) being dimensioned in such a manner that the efficiency or the torque of the drive device lies within a maximum range (II).

11 Claims, 3 Drawing Sheets

DRIVE DEVICE FOR A ROTARY ANODE OF AN X-RAY TUBE

BACKGROUND OF THE INVENTION

The invention relates to a drive device for a rotary anode of an X-ray tube having a drive motor with a stator and a rotor which drives the rotary anode, the stator and the rotor being separated by a gap and the stator having slots whose circumferential length has been dimensioned for driving a bipolar X-ray tube.

Such a drive device is known from German Gebrauchmuster G 94 15 240.3. A bipolar X-ray tube is to be understood to mean an X-ray tube whose anode is at a positive potential with respect to ground potential and whose cathode is at a negative potential with respect to ground potential. When the rotor together with the rotary anode is at a high electric potential and the stator is at ground potential, the necessary potential isolation is guaranteed by an appropriately dimensioned gap between the stator and the rotor. The circumferential length of the stator slots is selected to be as large as possible in order to ensure that the magnetic flux from the stator is guided radially inward towards the rotor in the most direct way and only a minimal portion of this magnetic flux is guided from one pole tooth of the stator to an adjacent pole tooth of the stator. The circumferential length of the stator slot is to be understood to mean the circumferential pathlength between two adjacent pole teeth corners of two adjacent pole teeth, which face the gap.

An X-ray tube, in which the rotary anode is coupled to ground potential and in which only the cathode potential differs from ground potential, is referred to as a unipolar X-ray tube. In a drive device for such a unipolar X-ray tube the rotary anode, the stator and the rotor are therefore coupled to ground potential. Since the gap between the stator and the rotor need not guarantee potential isolation, it can be made as small as mechanically possible in order to achieve an optimum magnetic linkage between the stator and the rotor. Owing to this small gap the circumferential length of the slots of the stator which has been constructed specifically for driving a unipolar X-ar tube can be selected very small, without a significant portion of the magnetic flux issuing from the stator being directed from one pole tooth of the stator to an adjacent pole tooth of the stator. In view of the unit cost for production, warehousing and maintenance of drive devices for rotary anodes of X-ray tubes it is a disadvantage that for the above constructions a separate drive motor is used for the bipolar X-ray tube and for the unipolar X-tube.

SUMMARY OF THE INVENTION

It is an object of the invention to provide a drive device of the type defined in the opening paragraph, which is suitable for more universal use.

According to the invention this object is achieved in that for driving a unipolar X-ray tube, the diameter of the rotor and thus the gap have been dimensioned in such a manner that the efficiency or the torque of the drive device lies within a maximum range.

The stator which is dimensioned for driving a bipolar X-ray tube is used for driving the unipolar X-ray tube, whereas the rotor, which is of a less intricate mechanical construction, is dimensioned especially for driving a unipolar X-ray tube. Thus, the stator, whose circumferential slot length is dimensioned for driving a bipolar X-ray tube, can be used both for driving a bipolar X-ray tube and for driving a unipolar X-ray tube, whereas a separate rotor is designed for the unipolar X-ray tube and for the bipolar X-ray tube. As a result of this, larger numbers of units with less diversification are attainable for the stator, which reduces the cost of all the driving tasks which can thus be fulfilled. For driving a unipolar X-ray tube the rotor is dimensioned in such a manner that the gap between the stator and the rotor is reduced in comparison with the gap dimensioned for a bipolar X-ray tube. This improves the flux linkage between the stator and the rotor. However, the gap should not be selected to be as small as mechanically permissible, because the harmonics produced by the stator slots with their large circumferential length then penetrate deep into the rotor and generate substantial eddy currents therein. This gives rise to losses and to harmonic moments which are opposed to the desired fundamental moments, as a result of which the efficiency and the useful torque are reduced. The gap size can be optimized as regards the efficiency or as regards the torque. The optimum for these two characteristics is not necessarily obtained at the same gap size.

In an embodiment of the invention the maximum range represents a gap size range which has been selected in such a manner that it lies in a favorable range between a range of large gap sizes, in which the flux linkage between the stator and the rotor is small, and a range of small gap sizes, in which losses as a result of harmonics occur in the rotor.

In a further embodiment of the invention the circumferential length of the slots of the stator lies in a range between 8 mm and 25 mm and the gap between the stator and the rotor is 15% to 35% of the circumferential length of the slots.

In the case of rotary anodes of bipolar X-ray tubes the anode potential and the rotor potential typically lie in a range of 40 kV to 75 kV. In order to guarantee the necessary potential isolation with respect to the grounded stator a gap between the stator and the rotor should typically lie in a range of 8 mm to 25 mm. The circumferential length of the stator slot is dimensioned in accordance with the size of this gap. Usually, it is selected to be just as large as or slightly larger than the gap between the stator and the rotor, i.e. for potential values of the rotary anode between 40 kV and 75 kV the circumferential length of the stator slot lies typically in a range between 8 mm and 25 mm. In order to guarantee a satisfactory efficiency or large torque of the drive device, the gap between the stator and the rotor should be 15% to 35% of the circumferential length of the stator slots. In the case of a smaller gap the losses as a result of harmonics in the rotor increase strongly because the flux linkage between the stator and the rotor is reduced considerably in the case of a larger gap. Both factors reduce the efficiency and the useful torque.

A further advantageous embodiment of the invention is characterized in that the rotor comprises two cylinders, the cylinder which faces the stator being made of an electrically highly conductive material, for example copper, and the cylinder which is remote from the gap is made of a magnetically highly conductive material, for example iron.

Owing to the provision of these two different cylinders the torque is increased and the losses are reduced.

A direct interconnection of the two cylinders in the case of inner rotors is possible only if the thermal load does not exceed certain limits; in the case of outer rotors higher temperatures are permissible in the rotor materials.

In a further advantageous embodiment of the invention the rotor is a hollow cylinder made of an electrically highly conductive material, for example copper, and a stationary cylinder made of a magnetically highly conductive material, for example iron, is disposed inside this hollow cylinder, these two cylinders being spaced apart by an additional gap.

This rotor construction allows a higher thermal load of the rotor than rotor constructions in which the two materials are coupled and rotate jointly.

In a further advantageous embodiment of the invention the vacuum separation between the rotor and the stator is provided by a non-magnetic separation layer, which also supports the stator lamination assembly, the separation layer preferably consisting of nickel chrome steel, a ceramic or glass.

The drive device in accordance with the invention is preferably used for driving the rotary anode of an X-ray tube.

BRIEF DESCRIPTION OF THE DRAWINGS

An embodiment of the invention of the invention will be described in more detail with reference to FIGS. 1 to 5. In the drawings.

DETAILED DESCRIPTION OF THE PREFERRED EMBODIMENT

Figure 1:
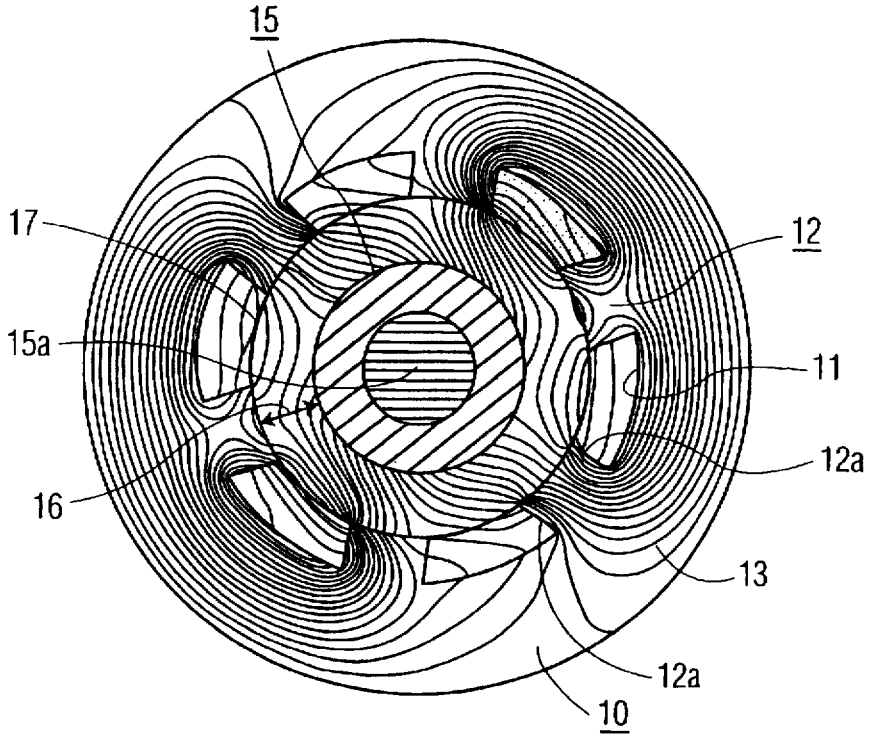
FIG. 1 is a sectional view of a drive motor for a rotary anode of a bipolar X-ray tube having a stator and a rotor which drives the rotary anode, the stator and the rotor being dimensioned for driving the bipolar X-ray tube.

FIG. 1 shows a drive motor for a rotary anode, not shown, of a bipolar X-ray tube, not shown. The drive motor comprises a stator 10 with slots 11 and stator teeth 12 having tooth flanks referenced 12*a*. The slots 11 of the stator 10 accommodate windings, not shown, which generate a magnetic field 13 in operation. The rotor 15 is spaced from the stator 10 by a comparatively wide air or vacuum gap 16. The rotor 15 has a rotor shaft 15*a* for driving the rotary anode, not shown. The rotary anode, not shown, is coupled to a high potential of, for example, 75 kV. The rotor 15, which drives the rotary anode by means of the rotor shaft 15*a*, is also coupled to this high potential of 75 kV, the stator 10 being coupled to ground potential. Therefore, a comparatively large air gap 16 is required between the stator 10 and the rotor 15 for potential isolation. The circumferential length 17 of the slots 11 is selected to be as large as possible in order to ensure that the flux issuing from the stator 10 is guided radially inward towards the rotor 15 in the most direct way. If, as in the present exemplary embodiment, the rotary anode and the rotor 15 are operated at a potential of +75 kV, a typical value for the size of the air gap is 15 mm. In this case the circumferential length 17 of the stator slots 11 is of the same order of magnitude as the air gap size, for example in a range of 10 mm to 20 mm. Thus, in this embodiment described with reference to FIG. 1, both the stator 10 and the rotor 15 have been dimensioned for driving a bipolar X-ray tube, (i.e. the rotor 15 and the rotary anode, not shown, are coupled to a high potential), a cathode, not shown, of the X-ray tube is coupled to a high negative potential, and the stator 10 is coupled to ground potential.

Figure 2:
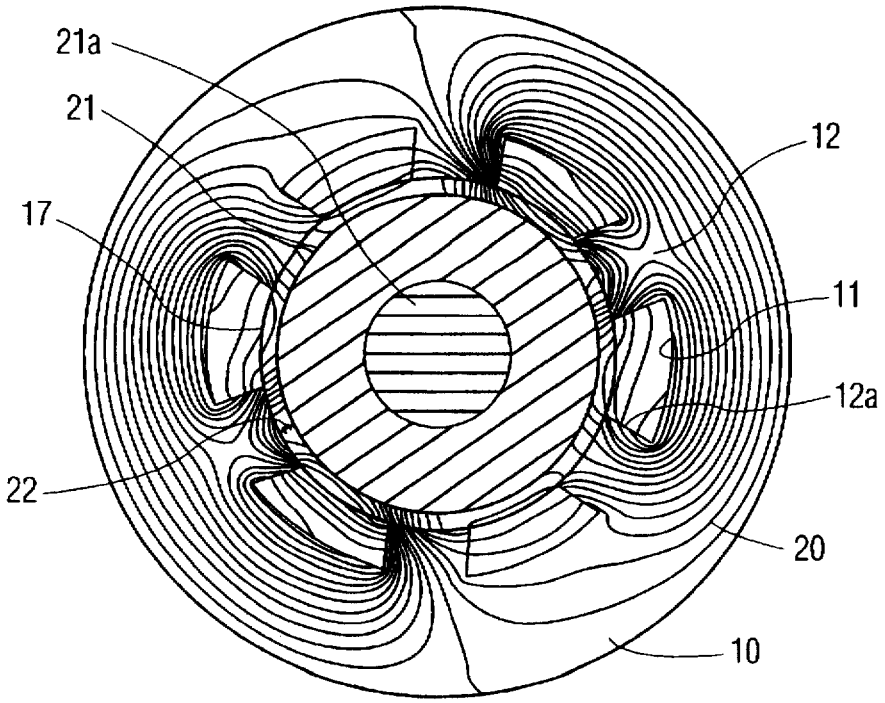
FIG. 2 is a sectional view of a drive motor for a rotary anode of a unipolar X-ray tube having a stator and a rotor which drives the rotary anode, the stator of FIG. 1 being dimensioned for driving the bipolar X-ray tube and the rotor being dimensioned for driving the unipolar X-ray tube.

FIG. 2 shows a drive motor for a rotary anode, not shown, of a unipolar X-ray tube, not shown. In such a unipolar X-ray tube the rotary anode, not shown, is coupled to ground potential. The stator of the drive motor shown in FIG. 2 is identical to the stator 10 of the drive motor shown in FIG. 1. Therefore, the same reference numerals as in FIG. 1 is used for the stator shown in FIG. 2. Accordingly, the drive motor shown in FIG. 2 comprises a stator 10 with slots 11 and stator teeth 12 having tooth flanks referenced 12*a*. The slots 11 accommodate windings, not shown, which in operation generate a magnetic field 20 which differs from the magnetic field 13 shown in FIG. 1 because the drive motor shown in FIG. 2 has a rotor 21 which differs from that of the drive motor shown in FIG. 1. The rotor 21 is spaced from the stator 10 by a considerably smaller air or vacuum gap 22. It has a rotor shaft 21*a* for driving the rotary anode, not shown. Since the drive motor shown in FIG. 2 is used for driving a unipolar X-ray tube the rotary anode, not shown, the rotor 21 as well as the stator 10 are at ground potential. As the gap 22, unlike the gap 16 shown in FIG. 1, need no longer provide potential isolation between the stator 10 and the rotor 21 it can be dimensioned correspondingly smaller. This results in an improved linkage of the magnetic field generated by the windings, not shown, which are disposed in the slots 11, to the rotor 21. The gap 22, however, should not be dimensioned as small as mechanically possible, because the harmonics produced by the large circumferential length 17 of the stator slots 11 then give rise to substantial losses in the rotor 21 and the torque of the drive motor is reduced. There is an optimum value for the size of the gap 22 at which the efficiency or the torque of the drive motor shown in FIG. 2, for driving a unipolar X-ray tube, reaches a maximum. In practice, the drive motor shown in FIG. 2 has a satisfactory efficiency or a satisfactory torque when the gap 22 between the stator 10 and the rotor 21 is 15% to 21% of the circumferential length 17 of the stator slots 11.

Figure 3:
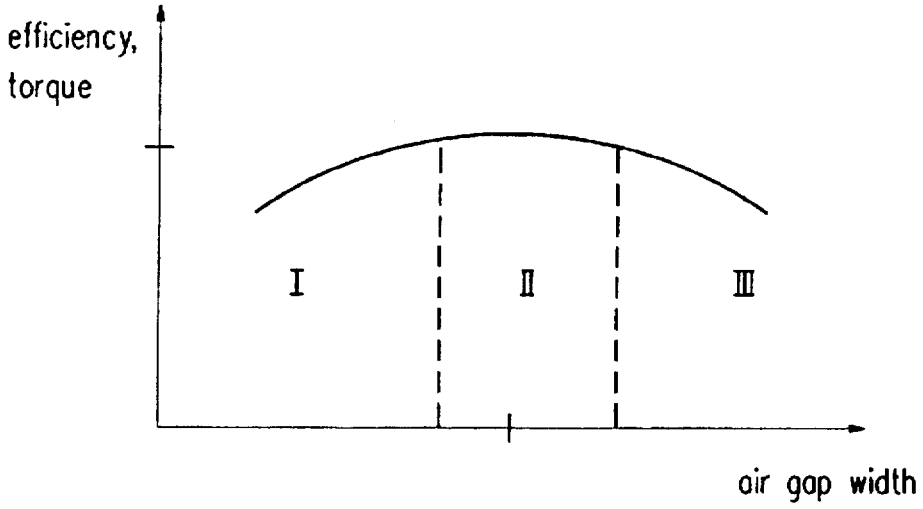
FIG. 3 shows diagrammatically the efficiency or torque of the drive device of FIG. 1 in dependence on the size of the gap between the stator and the rotor.

FIG. 3 shows the efficiency or torque of the drive motor shown in FIG. 2 used for driving a unipolar X-ray tube in dependence on the size of the gap 22 between the stator 10 and the rotor 21. It is apparent that in a first range I an unsatisfactory efficiency or an unsatisfactory torque is obtained, because the losses as a result of harmonics in the rotor 21 are very high. The range I is adjoined by a maximum range II, in which a satisfactory efficiency or a satisfactory torque of the drive motor is obtained. This maximum range 11 is followed by a range III, in which the drive motor has an unsatisfactory efficiency or an unsatisfactory torque, because the flux linkage between the stator 10 and the rotor 21 is reduced substantially as a result of the large gap 22.

Figure 4:
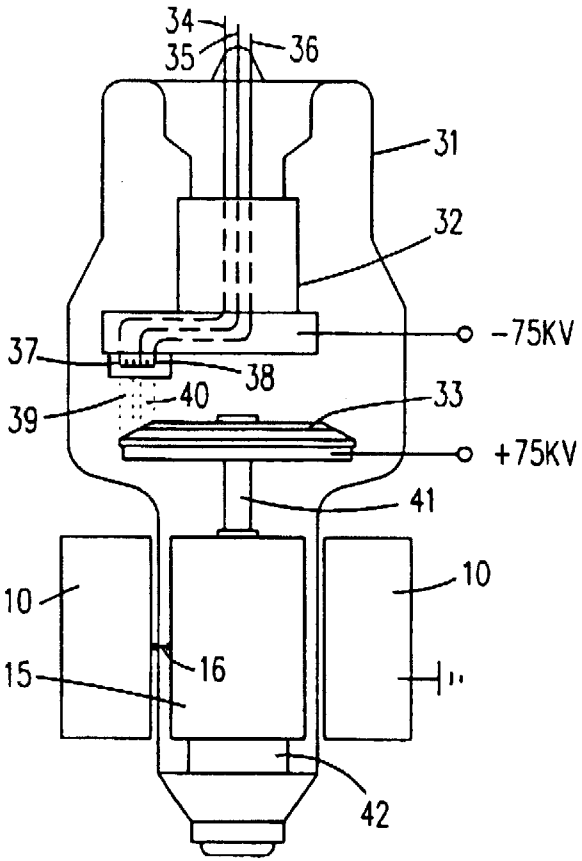
FIG. 4 shows diagrammatically a bipolar X-ray tube having a rotary anode for use in conjunction with a drive motor in accordance with FIG. 1.

FIG. 4 shows diagrammatically a bipolar X-ray tube with a vacuum envelope 31. The vacuum envelope 31 accommodates a cathode array 32 having supply leads 34, 35 and 36, which lead to thermionic cathodes 37 and 38. Depending on the arrangement of the supply leads 34, 35 and 36, electron beams 39 and/or 40 can be directed from these thermionic cathodes 37 and 38 to a rotary anode 33. The cathode array 32 is coupled to a high negative potential of, for example −75 kV.

The rotary anode 33 is connected to the rotor 15 via a shaft 41 as shown in FIG. 1, the rotor being journaled on a connection member 42. To drive the rotor 15 the stator 10 in accordance with FIG. 1 is disposed on the outside of the vacuum envelope 31. In the same way as in FIG. 1, the rotor 15 and the stator 10 are separated by the air gap 16.

The rotary anode 33 and the rotor 15 are coupled to a high positive potential of, for example 75 kV, the stator 10 being coupled to ground potential. Therefore, the comparatively large air gap 16 is required for the potential isolation between the stator 10 and the rotor 15.

Figure 5:
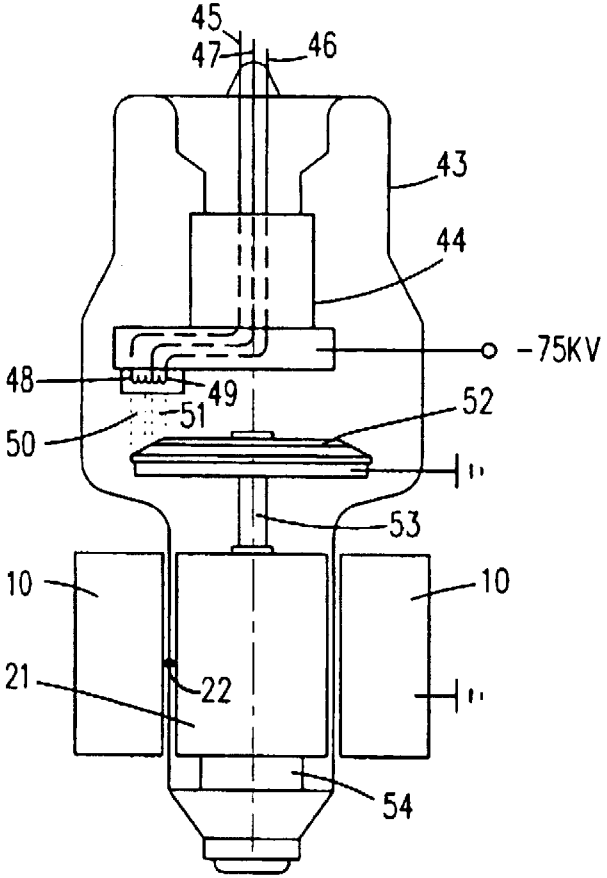
FIG. 5 shows diagrammatically a unipolar X-ray tube having a rotary anode for use in conjunction with a drive motor in accordance with FIG. 2.

FIG. 5 shows diagrammatically a unipolar X-ray tube of essentially the same construction as the bipolar X-ray tube shown in FIG. 4. Thus, it comprises a vacuum envelope 43 in which a cathode array 44 is mounted. The cathode array 44 is coupled to a negative potential of, for example, −75 kV. The cathode array 44 has supply leads 45, 46 and 47, which lead to thermionic cathodes 48 and 49. Depending on the arrangement of the supply leads 45, 46 and 47 electron beams 50 and/or 51 can be directed from these thermionic cathodes to a rotary anode 52. The rotary anode 52 is connected to the rotor 21 via a shaft 53 as shown in FIG. 2, the rotor being journaled on a connection member 54. To drive the rotor 21 the stator 10 in accordance with FIG. 2 is arranged on the outside of the vacuum envelope 43. The rotary anode 52, the rotor 21 and the stator 10 are coupled to ground potential. Accordingly, the rotor 21 is spaced from the stator 10 by an air gap or vacuum gap 22 which is substantially smaller than the air gap 16 in FIG. 4.

The present invention discloses a possibility of using the stator shown in FIGS. 1 and 2, which is dimensioned for driving a bipolar X-ray tube and which consequently has a large circumferential length of the stator slots 11, both for driving a bipolar X-ray tube and for driving a unipolar X-ray tube. For driving a bipolar X-ray tube the rotor 15 shown in FIG. 1 is then used, which guarantees a comparatively large gap 16 between the stator 10 and the rotor 15. For driving a unipolar X-ray tube the rotor 21 shown in FIG. 2 is used, which has a smaller gap 22. When this gap 22 is dimensioned there is an optimum value for the size of this gap 22, for which a maximum torque or a maximum effciency of the drive motor for driving a unipolar X-ray tube is obtained.

It will thus be seen that the objects set forth above and those made apparent from the preceding description are efficiently attained, and since certain changes can be made in the above construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

I claim:

1. A drive device for a rotary anode of an X-ray tube comprising a drive motor with a stator and a rotor, the stator and the rotor being separated by a gap, the stator having slots with a circumferential length falling within a range between about 8 mm and 25 mm and the gap between the stator and the rotor falling within a range between about 15% to 35% of the circumferential length.

2. An X-ray tube comprising a drive device as claimed in claim 1.

3. A unipolar X-ray tube having a vacuum envelope which accommodates a cathode coupled to a negative potential and a rotary anode coupled to ground potential, the rotary anode being connected to a rotor which in conjunction with a stator (10) is arranged externally on the vacuum envelope and serves as a drive device for the rotary anode, characterized in that the drive device is constructed as claimed in claim 1.

4. The drive device as claimed in claim 1 characterized in that the rotor includes a first cylinder facing the stator and made of an electrically highly conductive material and a second cylinder remote from the gap and made of a magnetically highly conductive material.

5. The drive device as claimed in claim 1, characterized in that the rotor is a hollow cylinder made of an electrically highly conductive material and a stationary cylinder made of a magnetically highly conductive material and disposed inside the hollow cylinder, the hollow and stationary cylinders being spaced apart by an additional gap.

6. The drive device as claimed in claim 1, characterized in that the stator is a laminated assembly and wherein the axial length of the rotor is greater than or equal to the length of the laminated assembly.

7. The drive device as claimed in claim 6, further including a non-magnetic separation layer providing both a vacuum separation between the rotor and the stator and supporting the stator laminated assembly.

8. The device as claimed in claim 7, characterized in that the separation layer is selected from the group consisting of nickel chrome steel, a ceramic and glass.

9. A rotary anode having a drive device as claimed in claim 1.

10. The drive device of claim 4, wherein the electrically highly conductive material is copper and the magnetically highly conductive material is iron.

11. The drive device of claim 5, wherein the electrically highly conductive material is copper and the magnetically highly conductive material is iron.

* * * * *